US006578830B2

(12) United States Patent
Watts

(10) Patent No.: US 6,578,830 B2
(45) Date of Patent: Jun. 17, 2003

(54) GAS-FIRED HUMIDIFIER

(75) Inventor: Robert John Watts, East Sussex (GB)

(73) Assignee: Eaton-Williams Group Limited, Kent (GB)

( * ) Notice: Subject to any disclaimer, the term of this patent is extended or adjusted under 35 U.S.C. 154(b) by 0 days.

(21) Appl. No.: 09/851,139

(22) Filed: May 9, 2001

(65) Prior Publication Data

US 2002/0024157 A1 Feb. 28, 2002

(30) Foreign Application Priority Data

May 10, 2000 (GB) ..... 0011224

(51) Int. Cl.[7] ..... B01F 3/04

(52) U.S. Cl. ..... 261/141; 261/DIG. 10; 126/350.2; 237/78 R; 122/18.4; 122/235.23

(58) Field of Search ..... 261/130, 131, 261/141, 150, 156, DIG. 10, DIG. 76; 126/350.1, 350.2; 237/78 R; 122/18.4, 42, 43, 332, 459, 235.12, 235.14, 235.15, 235.23

(56) References Cited

U.S. PATENT DOCUMENTS 1,728,017 A * 9/1929 Szarka
3,487,620 A * 1/1970 Klein et al. ..... 261/DIG. 76
3,935,855 A * 2/1976 van Vliet
4,123,995 A * 11/1978 Ek
4,413,590 A * 11/1983 Landreau
5,199,384 A * 4/1993 Kayahara et al.
5,791,300 A * 8/1998 Phelps, Sr.
6,305,612 B1 * 10/2001 Besik
6,318,305 B1 * 11/2001 Takubo et al.
6,397,788 B2 * 6/2002 Besik

* cited by examiner

*Primary Examiner*—C. Scott Bushey
(74) *Attorney, Agent, or Firm*—Clark & Brody

(57) ABSTRACT

A gas-fired humidifier includes a heat exchanger with a plurality of generally upwardly extending tubes. These are connected at their lower ends to a source of water and at their upper ends to a steam header. A gas-fired burner is arranged to direct heat to the exterior of the tubes so as to cause water therein to boil and form steam in the steam header.

7 Claims, 3 Drawing Sheets

GAS-FIRED HUMIDIFIER

TECHNICAL FIELD

The present invention relates to a gas-fired humidifier.

BACKGROUND ART

Previous such constructions involve the passage of hot gases through generally horizontal tubes which extend through a tank of water, the water thereby being boiled to produce steam.

Such a construction is not very efficient.

SUMMARY OF THE INVENTION

The present invention seeks to improve the efficiency of gas-fired humidifiers.

Accordingly, the present invention is directed to a gas-fired humidifier comprising a heat exchanger with a plurality of generally upwardly extending tubes connected at their lower ends to a source of water and at their upper ends to a steam header, and a gas-fired burner arranged to direct heat to the exterior of the tubes so as to cause water therein to boil and form steam in the steam header.

Such an arrangement has the advantage that airlocks are unlikely to form in the tubes.

Preferably, the burner projects heat in a generally horizontal direction across the tubes.

The efficiency with which heat is transferred is further improved if the burner is provided with a diffuser plate, in front of which is located a flat mesh bed.

Preferably, the tubes are more closely spaced from one another in a first region than they are in a second region which is further away from the burner than the said first region.

Preferably, the tubes nearer the burner are made of a material having a lower heat conductivity than the tubes which are further from the burner.

Preferably, the tubes which are nearer the burner are not finned or have a relatively small amount of fin material, whereas the tubes further from the burner are provided with fins or have a larger amount of fin material.

The tubes which are nearer the burner may be flanked with water jackets which are also connected at their lower ends to a said source of water and at their upper ends to the steam header.

In this way it will be seen that the ease with which heat is transferred from the flame or hot gases ejected by the burner is greater at positions further away from the burner to compensate for the drop in temperature of the flame or hot gases in those regions.

BRIEF DESCRIPTION OF THE DRAWINGS

An example of a gas-fired humidifier made in accordance with the present invention is illustrated in the accompanying drawings, in which.

DETAILED DESCRIPTION OF THE PREFERRED EMBODIMENTS

Figure 1:
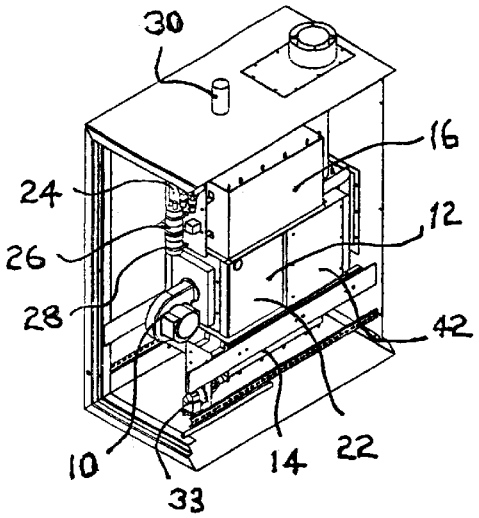
FIG. 1 shows a part cut-away isometric view of the example humidifier.

The gas-fired humidifier shown in FIG. 1 shows a gas-fired burner with fan 10 located to direct a flame or hot gaseous material into a heat exchanger 12. The latter is sandwiched between a water tank 14 below the heat exchanger 12 and a steam header 16 arranged above the heat exchanger 12. Vertically extending tubes 18 and 20 extend between and are in communication with the water tank 14 and the steam header 16.

The tubes 18 which are nearer to the burner 10 than the tubes 20 are more densely packed so that they are spaced apart from one another to a lesser extent than the tubes 20. Furthermore, the tubes 18 and 20 are made of stainless steel. Also, the tubes 18 are not finned whereas the tubes 20 are provided with copper fins. Lastly, the tubes 18 are flanked by side wall water jackets 22, which also extend between and are in open communication with the water tank 14 and the steam header 16.

Water is fed to the water tank 14 via a tundish 24 in dependence upon a solenoid valve 28 operated by a float switch 26.

Gas is fed to the gas-fired burner 10 via a valve 27.

Steam is fed out from the steam header 16 via an outlet 30.

The humidifier is provided with a central processing unit 32 to which are connected a setting adjuster 34 and temperature sensors 36, the latter being arranged in the outlet 30. The burner valve 27 is connected to and controlled by the central processing unit 32.

A drain pump 33 enables the system to be drained of water.

A diffuser plate 38 and a flat mesh bed 40 ensure an even distribution of hot gases from the burner 10. Insulated access doors 42 are provided adjacent to the tubes 20, which are further from the burner 10.

When the illustrated gas-fired humidifier is in operation, hot gases from the burner 10 are directed therefrom in a generally horizontal direction across the heat exchanger 12. This boils the water in the tubes 18 and 20 and also in the jackets 22. Although the tubes 20 are shielded from the burner by the tubes 18, they are able to extract heat from the surrounding hot gases more efficiently so that the transfer of heat to the output interior is the same or quite close to the transfer of heat to the interiors of the closer tubes 18. Water in the tubes 18 and 20 is thereby boiled to create a head in steam in the steam header 16, the temperature of the steam in the outlet 30 being detected by the sensors 36 and relayed to the central processing unit 32. The float switch 26 ensures that the level of water in the tubes is maintained, notwithstanding that it is being continuously boiled away.

According to the temperature of the steam in the outlet 30 as detected by the sensors 36 and tile setting of the humidifier selected at the setting adjuster 34, the central processing unit 32 determines the amount of gas burnt by the burner 10 by adjusting the burner valve 27 accordingly.

Figure 2:
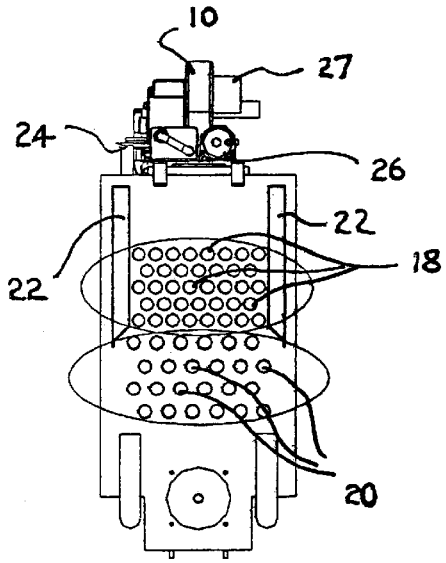
FIG. 2 shows a plan view in part-section of the humidifier shown in FIG. 1.
Figure 3:
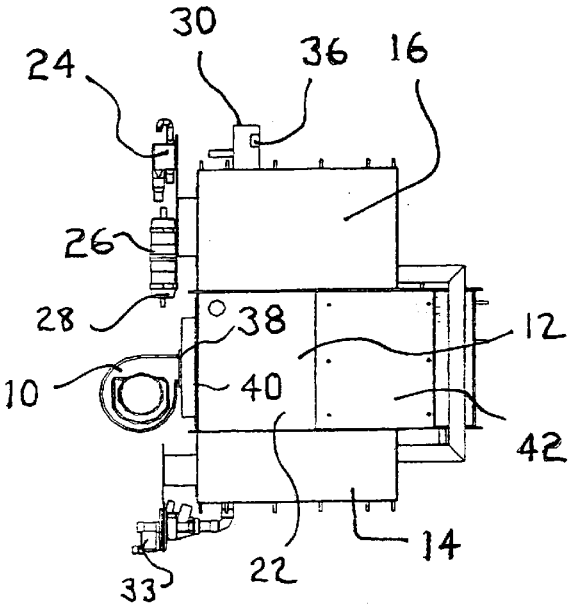
FIG. 3 shows a side view of the humidifier in FIG. 1.
Figure 4:
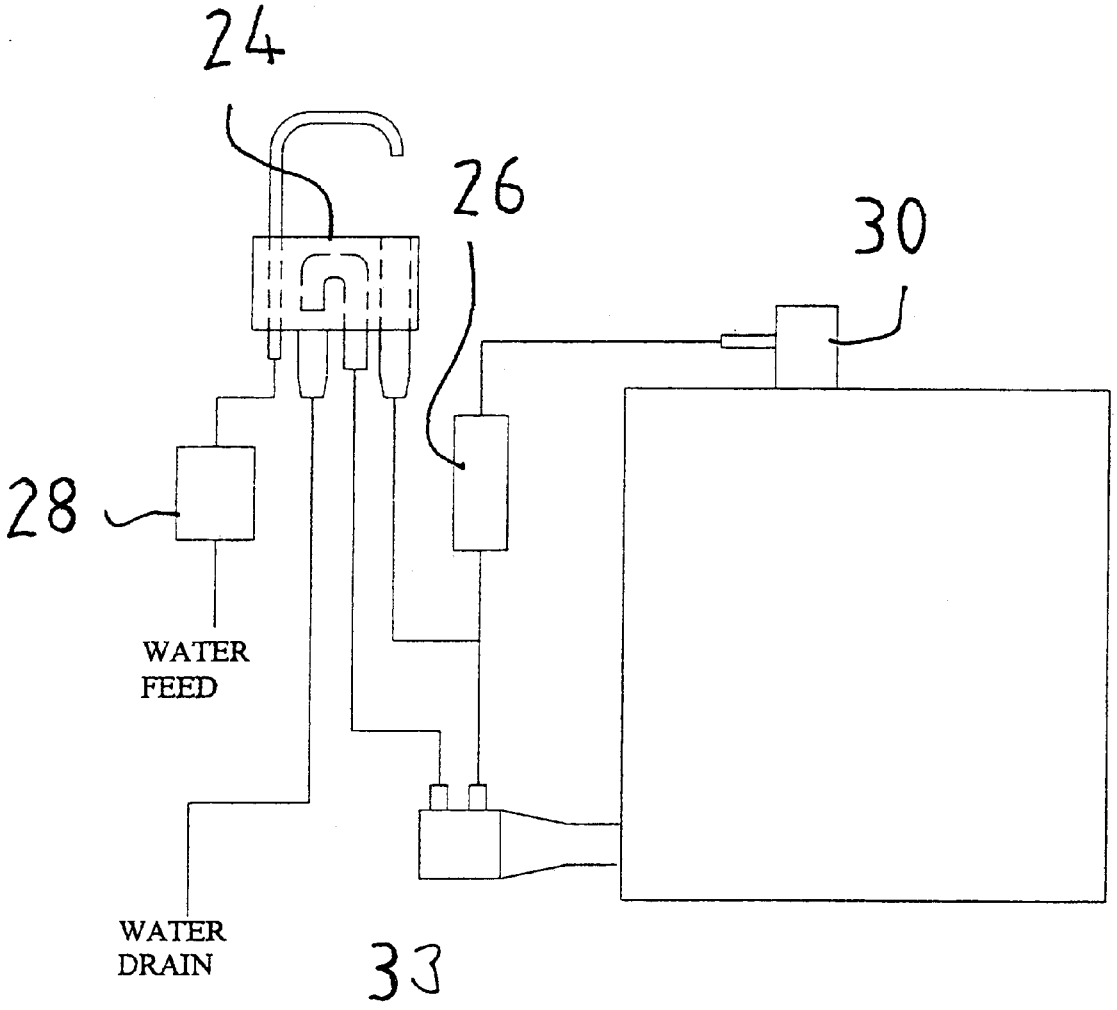
FIG. 4 shows a hydraulic circuit diagram of the humidifier shown in FIGS. 1 to 3.
Figure 5:
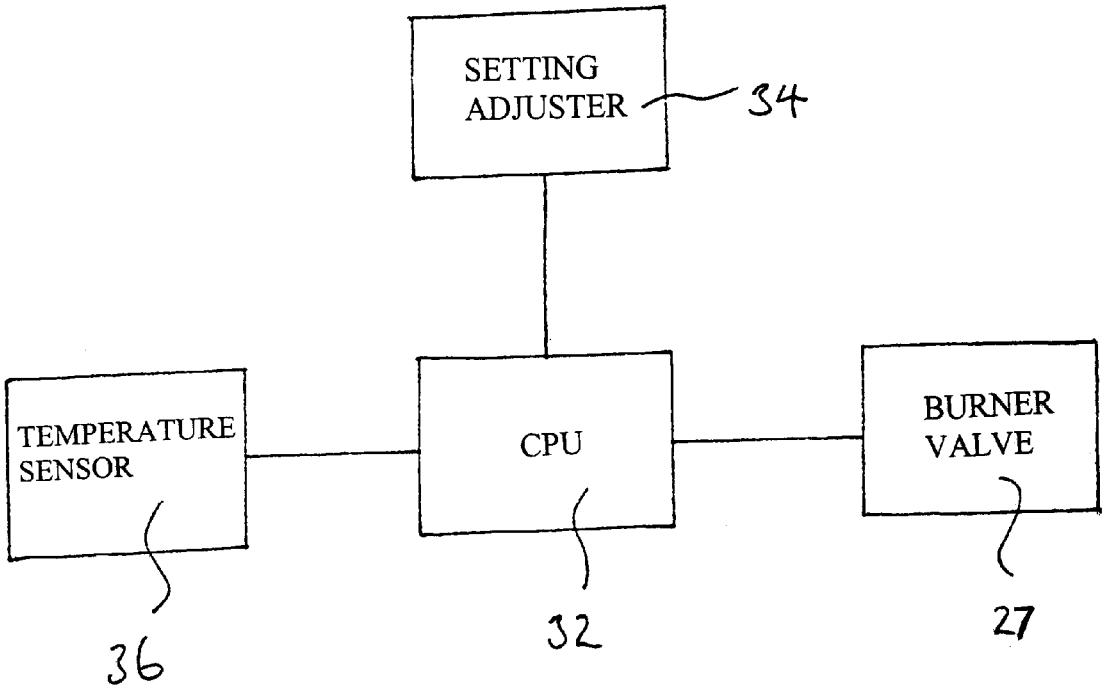
FIG. 5 shows a block circuit diagram of electrical circuitry used in the humidifier shown in FIGS. 1 to 3.

Various modifications to the illustrated humidifier may occur to the reader without taking the resulting construction outside the scope of the present invention. For example, the spacing between the pipes 18 and 20 can increase gradually from the burner end to the far end of the heat exchanger 12 rather than in a step function as shown in FIG. 2.

I claim:

1. A gas-fired humidifier comprising a heat exchanger, a plurality of generally upwardly extending tubes of the heat exchanger, a source of water to which the lower ends of the tubes are connected, a steam header to which the upper ends of the tube are connected, and a gas-fired burner arranged to direct heat to the exterior of the tubes so as to cause water therein to boil and form steam in the steam header, wherein the tubes are more closely spaced from one another in a first region than they are in a second region that is further away from the burner than the said first region.

2. A gas-fired humidifier according to claim 1, wherein the burner projects heat in a generally horizontal direction across the tubes.

3. A gas-fired humidifier according to claim 1, wherein the burner is provided with a diffuser plate.

4. A gas-fired humidifier according to claim 3, wherein a flat mesh bed is provided between the diffuser plate and the tubes.

5. A gas-fired humidifier according to claim 1, wherein the tubes nearer the burner are made of a material having a lower heat conductivity than tubes which are further from the burner.

6. A gas-fired humidifier according to claim 1, wherein tubes further from the burner are provided with fins, whereas tubes which are nearer the burner have a relatively small amount of fin material to zero fin material.

7. A gas-fired humidifier according to claim 1, wherein tubes which are nearer the burner than others of the tubes are flanked with water jackets which are also connected at their lower ends to said source of water and at their upper ends to the steam header.

* * * * *